United States Patent [19]

Ovaskainen

[11] Patent Number: 4,784,756

[45] Date of Patent: Nov. 15, 1988

[54] PNEUMATIC CLASSIFYING PROCEDURE AND MEANS

[75] Inventor: Pertti Ovaskainen, Rapattila, Finland

[73] Assignee: Larox Oy, Finland

[21] Appl. No.: 19,793

[22] PCT Filed: May 5, 1986

[86] PCT No.: PCT/FI86/00044

§ 371 Date: Dec. 31, 1986

§ 102(e) Date: Dec. 31, 1986

[87] PCT Pub. No.: WO86/06660

PCT Pub. Date: Nov. 20, 1986

[30] Foreign Application Priority Data

May 3, 1985 [FI] Finland ..... 851762

[51] Int. Cl.[4] ..... B04C 3/00

[52] U.S. Cl. ..... 209/144; 209/154

[58] Field of Search ..... 209/135, 144, 915, 133, 209/138, 154, 233

[56] References Cited

U.S. PATENT DOCUMENTS 1,832,256 11/1931 Stebbins ..... 209/144

3,878,091 4/1971 Hukki ..... 209/144

4,248,699 2/1981 Hukki ..... 209/144

*Primary Examiner*—Sherman D. Basinger

*Assistant Examiner*—Jesûs D. Sotelo

[57] ABSTRACT

The invention concerns a pneumatic classifying procedure and apparatus for dividing particulate material into a fine product consisting of lighter particles and a coarse product consisting of heavier particles. The classification takes place in a cylindrical classifying space (1) in which can be established a centrifugal field with the aid of tangential supply of the material to be classified or with the aid of a mechanical rotor, the field separating the fine product into the center of the classifying space and the coarse product to its outer margin. It is essential in the invention that the coarse product is removed with the aid of a separate gas flow which is tangential to the centrifugal field. The gas flow runs in a passage (11) which is tangential to the classifying space (1) at the site of the coarse product removal aperture (9). When the coarse product has been separated from the gas flow, the gas may be returned to the process to serve as fluid in the centrifugal classification taking place in the classifying space (1) of the process.

8 Claims, 2 Drawing Sheets

PNEUMATIC CLASSIFYING PROCEDURE AND MEANS

Figure 1:
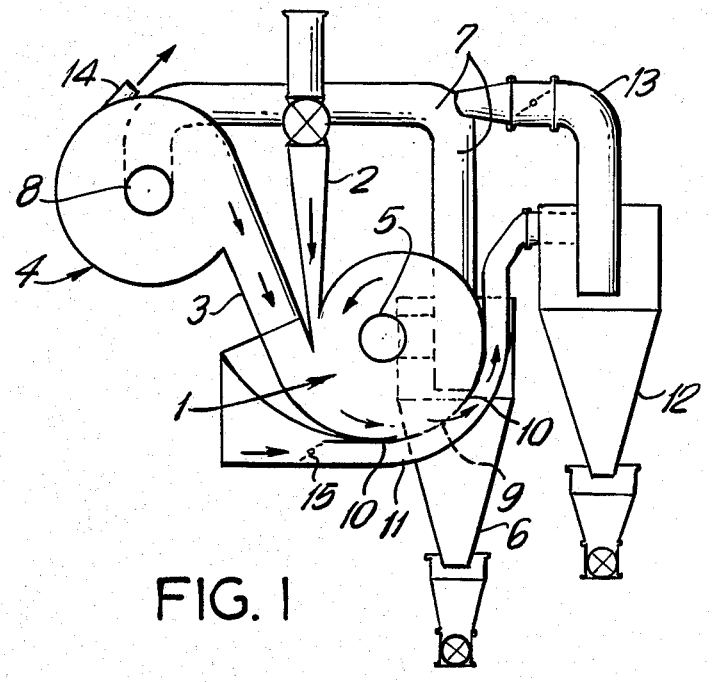

The present invention concerns a pneumatic classifying procedure wherein particulate material is, with the aid of centrifugal force, divided into a fine product consisting of lighter particles and a coarse product consisting of heavier particles and wherein the fine product is removed from the central part of the centrifugal field and the coarse product from its outer margin.

In pneumatic classifying of particulate material, prior art has employed, towards producing a centrifugal field causing classification, blowers setting the material in rotary motion, and mechanical rotors. The separation limit of such classification, that is the limiting size between fine particles and coarse product particles has usually been controlled by the aid of the rotational speed of the centrifugal field.

The coarse product can be separated, and removed from the centrifugal field, utilizing gravity when the separation limit of classification is large enough, about 50 μm. When the separation limit goes down, what happens is that gravity is no longer sufficient to separate the coarse product from the classifying fluid rotating in the centrifugal field. In such cases the coarse product has been separated by removing, together with the product, the part of the classifying fluid accompanying it, to a separate coarse product cyclone. However, this method has the drawback that at the same time part of the fine product contained in the material will be entrained with the coarse product. Therefore the sharpness of separation will be poor in such classification, and it is progressively impaired, the finer the adjustment of the separation limit is made, by increasing the proportion of fluid flow going along with the coarse product.

The object of the present invention is to eliminate the drawback mentioned, by devising a classifying procedure by which better sharpness of separation than before is achieved and which is superior to procedures of prior art also as regards controllability of the process. The classifying process of the invention is characterized in that the coarse product is removed from the centrifugal field with the aid of a separate gas flow tangential to the centrifugal field.

The advantageous effect of the principle taught by the invention, i.e., of employing a separate gas flow which does not participate in the classifying process, is substantially based on the fact that said pure gas flow totally or partly replaces, in the coarse product removal, the classifying fluid rotating in the centrifugal field and containing fine product constituents of the material which is being classified. Thereby the entraining of fine product with the flow removing coarse product is minimized or entirely inhibited.

The gas employed towards removing the coarse product, from which the coarse product is separated in a cyclone, may advantageously be returned, after said process, to the classifying process to serve as fluid in the classification taking place in the centrifugal field.

The invention also concerns a means for classifying particulate material pneumatically, by the procedure just described. The means comprises, in a manner known in itself in the art, a classifying space in which a centrifugal field can be established; at least one feed passage for conducting material to be classified, and gas serving as fluid medium, into the classifying space; and exit apertures for removal of the fine product, consisting of lighter particles, from the central part of the classifying space and for removal of the coarse product, consisting of heavier particles, on the outer margin of the classifying space, and the means is characterized in that it has been provided with a passage which is tangential to the classifying space adjacent to the coarse product removal aperture so that the coarse product can be removed with the aid of a gas flow conducted through said passage.

In an advantageous embodiment of the invention, the size of the coarse product aperture opening into the passage which is tangential to the classifying space has been arranged to be adjustable.

It is possible with the aid of the removal aperture's size to regulate the separation limit of classification, and in combination with control of the strength of the centrifugal field this endows the entire process with a wide, and easily controlled, range of regulation.

Figure 2:
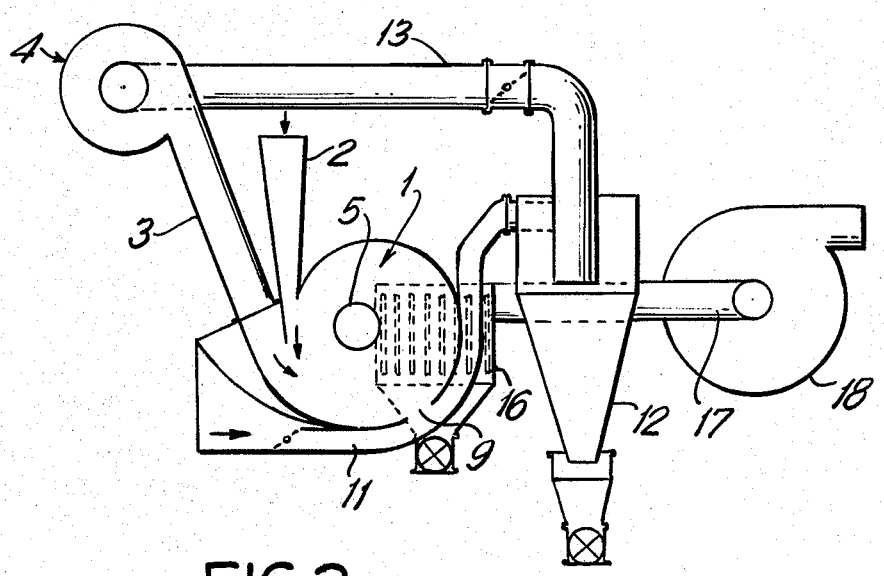
Figure 3:
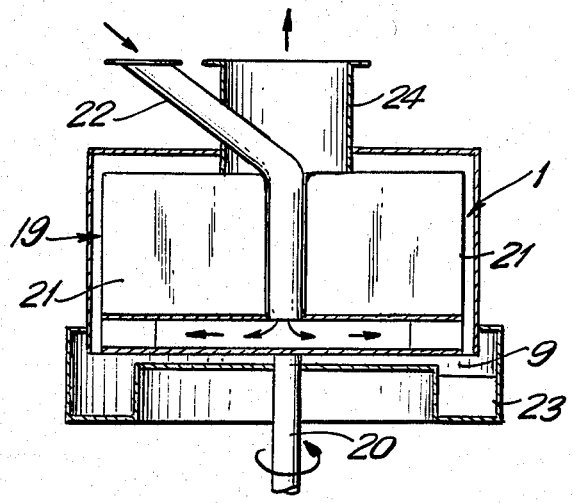
Figure 4:
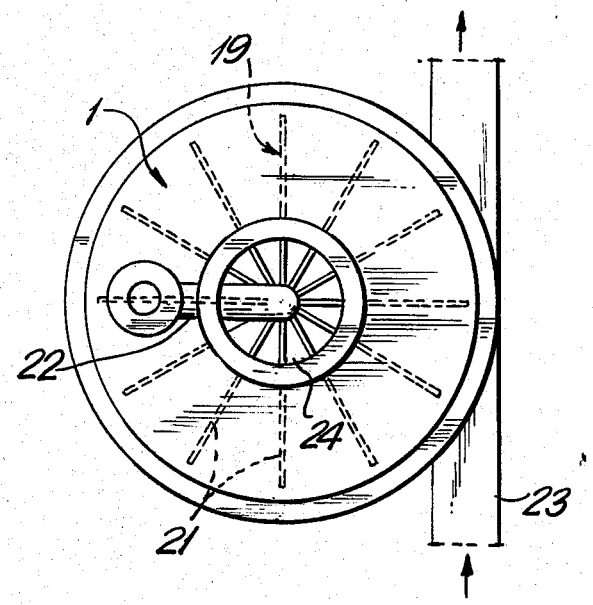

The invention is described, in the following, more in detail with the aid of examples, reference being made to the attached drawings, wherein:

FIG. 1 presents a classifying apparatus according to the invention wherein the centrifugal field is produced with the aid of a blower supplying gaseous classifying fluid into the classifying space, FIG. 2 presents another classifying apparatus according to the invention wherein the centrifugal field is produced with the aid of a blower supplying gaseous classifying fluid into the classifying space, FIG. 3 shows a vertical section through a classifying apparatus according to the invention wherein the centrifugal field is produced with the aid of a rotor disposed within the classifying space, and FIG. 4 shows the apparatus of FIG. 3, in top view.

In FIG. 1 is depicted a pneumatic classifying apparatus which divides particulate material composed of various sized solid particles into a fine product consisting of lighter particles and a coarse product consisting of heavier particles. Classification takes place with the aid of centrifugal force in the centrifugal field established in a substantially cylindrical classifying space 1 with horizontal axis. The centrifugal field is created, and maintained, by tangential supply into the classifying space 1 of the particulate material to be classified and of a gaseous classifying fluid. The particulate material and the fluid are set in rotary motion in the classifying space 1, where the fine product become separated to reside in the center of the classifying space and the coarse product, on its outer margin.

The supply of particulate material and of gaseous fluid into the classifying space is through feed passages 2,3 joining the classifying space tangentially and of which the passage 3 supplying fluid has been provided with a blower 4. The fine product removal aperture 5 is located roughly on the horizontal central axis of the classifying space 1 and it leads to a cyclone 6, which separates the fine product from the fluid escaping together with it. From the cyclone 6, the fluid is returned by a connecting passage 7 to the blower 4, to be reused as fluid for the classifying process. The intake aperture 8 of the blower 4 has been provided with a guide vane control, with a speed of rotation control or equivalent (not shown) for controlling the separation limit in classification. The coarse product removal aperture 9 is located on the outer margin of the classifying space 1, having been formed in the substantially cylindrical shell confining the classifying space. The wall sections 10 of the classifying space on either side of the removal aperture 9 have been arranged to be movable so that it is possible with their aid to regulate the size of the removal aperture. The extreme position of the sections 10, in which the size of the removal aperture 9 is at its minimum, has been indicated with dotted lines in FIG. 1. For removal of the coarse product, a passage 11 has been conducted past the classifying space 1, its direction conforming to the direction of the flow in progress in the marginal part of the classifying space and the coarse product removal aperture 9 opening into this passage. Through the passage 11, gaseous fluid can be introduced, this fluid transporting the coarse product emerging from the classifying space 1 through the removal aperture 9 to a cyclone 12, which separates the coarse product from the fluid flow. From the cyclone 12, the fluid departs to a connecting passage 13, which joins the connecting passage 7 coming from the fine product cyclone 6 and thereby returns the fluid through the blower 4 to the classifying process, to serve as fluid in the classifying taking place in the centrifugal field. In order to maintain a balance between the material flows introduced into the classifying process and those removed therefrom, part of the fluid coming from the blower 4 is separated and directed into the passage 14 which conducts it through dust elimination apparatus (not depicted) and out from the process.

The purpose of the pure fluid flow conducted through the passage 11 and which does not participate in the classifying taking place in the centrifugal field in the classifying space 1 is to make the classification limit sharper by reducing the entrainment of fine product with the coarse product. The separation limit of the classification process, and its sharpness, can be regulated by means of the size of the removal aperture 9, the quantity of gaseous fluid conducted through the passage 11, the quantity of fluid escaping through the passage 14 and the power input of the blower 4. Regulation of the flow in the passage 11 is effected with the aid of a valve 15 disposed in this passage.

The classifying apparatus depicted in FIG. 2 differs from that of FIG. 1, in the first place, regarding the processing of the fine product removed from the classifying space 1. The fine product removal apertue 5 has been connected through a filter 16, and further through a passage 17, to a blower 18. The filter 16 retains the fine product departing from the classifying space 1, while at the same time the blower 18 draws the fluid accompanying the fine product through the filter, and removing it from the process. The separation of the coarse product with the aid of the fluid introduced by the passage 11 is equivalent to that which has been presented in connection with FIG. 1. The apparatus of FIG. 2 is intended to be used in particular in connection with those grinding and drying processes (e.g. spray grinding) where the material to be classified which the process produces contains part of the classifying fluid, which requires filtering.

In FIGS. 3 and 4 is depicted a classifying apparatus wherein the cylindrical, vertical classifying space 1 has been provided with a rotating rotor 19 producing a centrifugal field. The rotor 19 comprises a vertical shaft 20 and a plurality of vanes 21 projecting radially therefrom. Supply of the particulate material to be classified and of classifying fluid is through the passage 22 to the axis of the classifying space 1. The coarse product becomes separated, in the centrifugal field produced by the rotary motion of the rotor 19, to the outer margin of the classifying space 1 and the fine product, to its center, similarly as in the embodiments of the invention already described, and for removal of the coarse product there has been carried past the lower margin of the classifying space, a straight passage 23, substantially tangential in relation to the classifying space, through which gaseous fluid can be conducted. The fluid flow takes the coarse product along with itself, and the fine product separating in the center of the classifying space 1 escapes into the axial removal passage 24. The separation limit of the apparatus of FIGS. 3 and 4 can be regulated by means of the fluid flow conducted through the passage 23 and the speed of rotation of the rotor 19.

It is obvious to a person skilled in the art that different embodiments of the invention are not confined to the examples presented and that they may vary within the scope of the claims following below.

I claim:

1. A pneumatic classifying procedure wherein particulate material is divided with the aid of centrifugal force into a fine product consisting of lighter particles and a coarse product consisting of heavier particles and wherein the fine product is removed from the central part of a centrifugal field and the coarse product from its outer margin, characterized in that the coarse product is removed with the aid of a separate gas flow which is tangential to the centrifugal field.

2. Procedure according to claim 1, characterized in that the coarse product is separated from said gas flow in a cyclone (12), whereafter the gas flow is returned to the classifying process to serve as fluid in the classification taking place in the centrifugal field.

3. Procedure according to claim 1 or 2, characterized in that the particulate material to be classified and the gas serving as fluid are blown into the centrifugal field tangentially so that the blowing maintains the centrifugal field effecting classification.

4. Means for classifying particulate material, said means comprising a classifying space (1) in which a centrifugal field can be established; at least one supply passage (2,3,22) for conducting material to be classified and a gas serving as fluid into the classifying space; and removal apertures (5,9,24) for removing fine product consisting of lighter particles from the central part of the classifying space and for removal of coarse product consisting of heavier particles from the outer margin of the classifying space, characterized in that the means is provided with a passage (11,23) which is tangential to the classifying space (1) at the coarse product removal aperture (9) so that the coarse product can be removed by the aid of a gas flow conducted through the passage.

5. Means according to claim 4, characterized in that the size of the coarse product removal aperture (9) opening into the passage (11) which is tangential to the classifying space (1) is arranged to be adjustable.

6. Means according to claim 5, characterized in that the walls (10) confining the classifying space (1) on both sides of the coarse product removal aperture (9) are arranged to be movable so that the size of the removal aperture can be regulated by moving said walls.

7. Means according to any one of claims 4–6, characterized in that the passage (11) tangential to the classifying space (1) and which removes the coarse product is connected to a cyclone (12) which separates the coarse product from the gas flow, and that the cyclone is connected over a connecting passage (13,7) and a blower (4) to the set of supply passages (3) of the classifying space so that the gas can be returned to the classifying process to serve as fluid in the classification taking place in the centrifugal field.

8. Means according to claim 7, characterized in that the supply passage (3) for gas serving as fluid, leading from the blower (4) to the classifying space (1), is connected to the classifying space tangentially so that the centrifugal field effecting classification can be maintained by the aid of the blower.

* * * * *